US007770666B2

(12) United States Patent
Allen

(10) Patent No.: US 7,770,666 B2
(45) Date of Patent: Aug. 10, 2010

(54) DRILLING FLUID CONTAINING A RECOVERABLE LOST CIRCULATION MATERIAL AND METHOD OF USING AND RECOVERING THE SAME

(76) Inventor: Barrett Allen, 621 W. Huber, Weatherford, OK (US) 73096

( * ) Notice: Subject to any disclaimer, the term of this patent is extended or adjusted under 35 U.S.C. 154(b) by 0 days.

(21) Appl. No.: 12/100,971

(22) Filed: Apr. 10, 2008

(65) Prior Publication Data

US 2008/0264691 A1 Oct. 30, 2008

Related U.S. Application Data

(60) Provisional application No. 60/926,376, filed on Apr. 26, 2007.

(51) Int. Cl.
*E21B 21/00* (2006.01)
*E21B 21/06* (2006.01)
*C09K 8/03* (2006.01)

(52) U.S. Cl. ..... 175/66; 175/72; 175/206; 175/207; 209/39; 209/214; 209/215; 210/695; 507/140

(58) Field of Classification Search ..... None
See application file for complete search history.

(56) References Cited

U.S. PATENT DOCUMENTS

| | | | | |
|---|---|---|---|---|
| 2,276,075 | A | 3/1942 | Wuensch | |
| 3,887,474 | A | 6/1975 | Senfe et al. | |
| 4,222,444 | A | 9/1980 | Hamilton | |
| 4,269,279 | A * | 5/1981 | House | 175/66 |
| 4,476,027 | A | 10/1984 | Fox | |
| 4,594,169 | A | 6/1986 | Saito et al. | |
| 5,944,195 | A | 8/1999 | Huang et al. | |
| 6,464,009 | B2 * | 10/2002 | Bland et al. | 166/300 |
| 6,579,832 | B2 | 6/2003 | Jimenez et al. | |
| 6,746,611 | B2 | 6/2004 | Davidson | |
| 7,159,675 | B2 | 1/2007 | Eigner et al. | |

* cited by examiner

*Primary Examiner*—George Suchfield
(74) *Attorney, Agent, or Firm*—Dunlap Codding, P.C.

(57) ABSTRACT

A method to recover a lost circulation material from a drilling fluid used in a drilling operation comprising the steps of: directing a drilling fluid containing a lost circulation material into a drill string positioned in a well bore, the lost circulation material having a magnetic property; recovering the drilling fluid containing at least a portion of the lost circulation material from the well bore; and magnetically separating the lost circulation material from the drilling fluid.

5 Claims, 1 Drawing Sheet

DRILLING FLUID CONTAINING A RECOVERABLE LOST CIRCULATION MATERIAL AND METHOD OF USING AND RECOVERING THE SAME

CROSS REFERENCE TO RELATED APPLICATIONS

The present patent application claims priority to the provisional patent application identified by U.S. Ser. No. 60/926,376 filed on Apr. 26, 2007, the entire content of which is hereby incorporated herein by reference.

BACKGROUND

It is common in drilling industries to use a drilling fluid, also called drilling mud, as a lubricant during drilling operations, such as drilling oil wells, drilling natural gas wells, and in exploration drilling rigs.

Drilling fluids perform various functions when implemented during a drilling operation. More specifically, drilling fluids can provide any of the following functions:

- remove cuttings from the well
- assist in the control of formation pressures
- suspend and release cuttings
- seal permeable formations
- assist in maintaining wellbore stability
- minimize formation damage
- cool, lubricate and support the bit and drilling assembly
- transmit hydraulic energy to downhole tools and bit
- ensure adequate formation evaluation
- control corrosion to acceptable levels
- facilitate cementing and completion
- minimize environmental impact During a drilling operation, there are a number of factors to consider when selecting the proper drilling fluid for a particular well. The cost, availability of specific products, and environmental impact are examples of factors taken into account when choosing a drilling fluid. The different properties that a drilling fluid will have are also taken into account when selecting a drilling fluid. The different properties of the drilling fluid can affect the desired functions of the drilling fluid. The affects on the desired functions must be realized and the drilling fluids must be designed according to their influence on all functions and relative importance for each function.

Drilling fluids can be provided with various additives, such as thinners, fluid loss control agents, corrosion inhibitors, weight materials, clays, and lost circulation materials, to develop drilling fluids having specific properties to target some of the specific functions listed above.

Generally, drilling fluids are pumped through a drill string, out of the drill string, and across the drill bit to clean and cool the drill bit. The drilling fluid then travels back up an annular space between the drill string and the sides of the hole being drilled in the formation. As the fluid travels up, the drilling fluid will eventually enter the annulus between the drill string and the surface casing and ultimately emerge at the surface. Once the drilling fluid has emerged from the surface, the cuttings can be removed and the drilling fluid can be stored and/or recycled back into the drill string.

A common problem in using drilling fluids is a phenomenon known as lost circulation. Lost circulation is a subterranean loss of the drilling fluid while drilling. Certain types of geological formations are porous and during drilling the drilling fluids have a tendency to migrate into the formation rather than traveling into the annulus between the drill string and the formation walls and eventually emerging at the surface. This loss of drilling fluid can become costly.

Lost circulation materials, such as ground cedar, pine fiber, ground walnut, peanut shells, shredded paper, ground mica, and calcium carbonate, have been added to drilling fluids to plug porous zones in the formation. This permits larger amounts of the drilling fluid to better travel up to the surface and be recovered. The use of these types of lost circulation materials adds significant costs to the drilling fluids, and thus the entire drilling operation. The increased costs are generated when the drilling fluid is recovered at the surface and processed to remove the drill cuttings from the recovered drilling fluid. When removing the drill cuttings from the drilling fluid, there is no way to differentiate between the drill cuttings and the lost circulation materials still contained in the drilling fluid. Thus, the lost circulation materials are removed along with the drill cuttings and have to be replaced with new lost circulation material. In the alternative, the drill cuttings and the lost circulation materials are left in the recovered drilling fluid and recycled back into the drill string. Over time, this causes a build up of the drill cuttings and the lost circulation materials in the drilling fluid and increases in the weight of the drilling fluid, which causes several negative effects on the well bore while drilling.

DETAILED DESCRIPTION OF EXEMPLARY EMBODIMENTS

Figure 1:
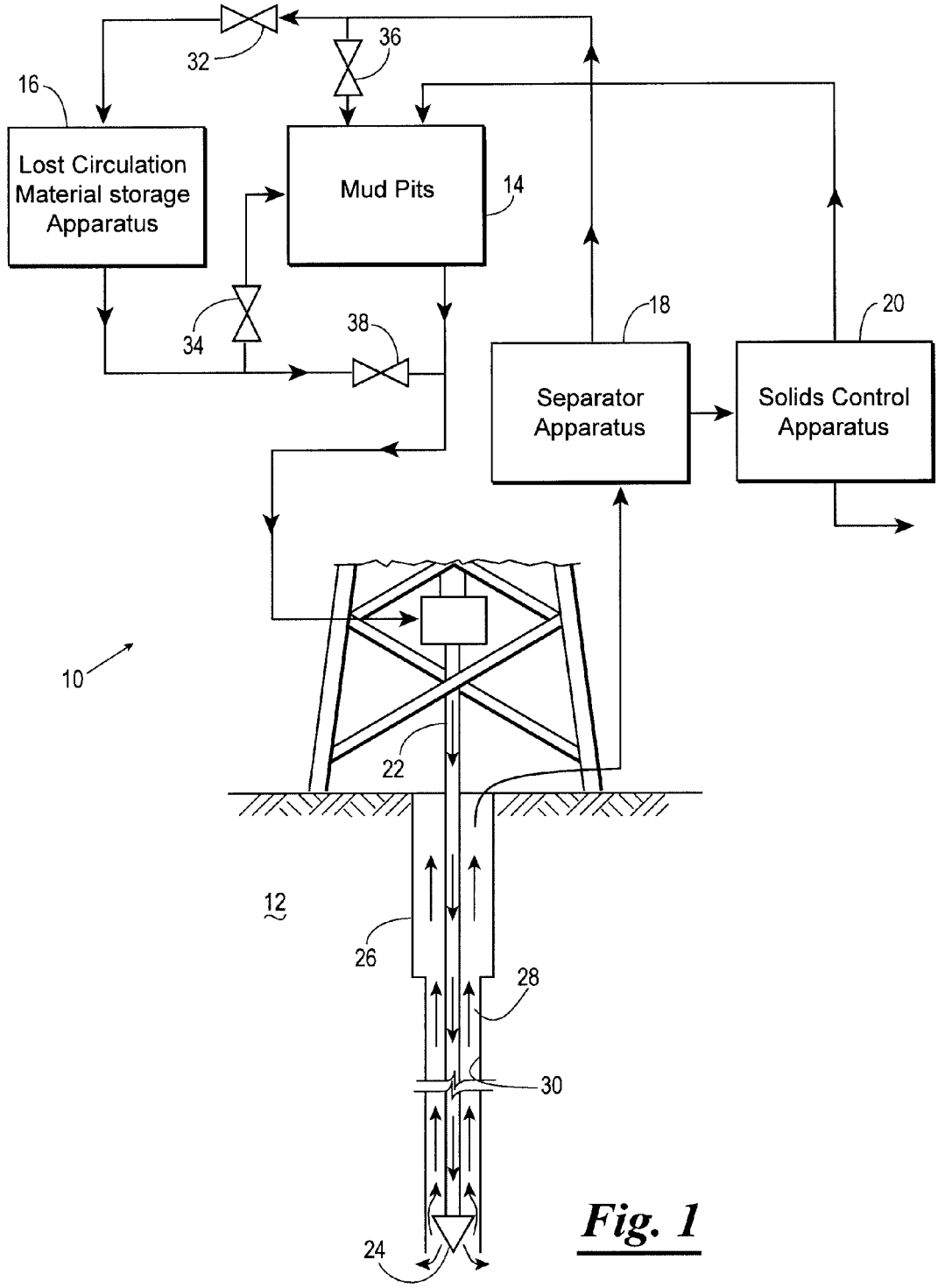
FIG. 1 is a partial side elevational view and partial block diagram of a drilling fluid system in accordance with the present invention.

FIG. 1 shows a drilling fluid system 10 for providing a recoverable lost circulation material to a subterranean formation 12 and recovering the recoverable lost circulation material from the spent drilling fluid in accordance with the present invention. The drilling fluid system 10 is provided with a mud pit 14 to store the drilling fluid, a lost circulation material storage apparatus 16 for storing lost circulation material not in use, a separator apparatus 18 for separating the recoverable lost circulation material from spent drilling fluid, a solids control apparatus 20 for removing drill cuttings from the spent drilling fluid, and a drill string 22 for supplying the drilling fluid to a drill bit 24, and ultimately to the formation 12. The system 10 includes a plurality of valves 32, 34, 36, and 38 to selectively control the path and storage location of the recoverable lost circulation material.

One embodiment of the present invention is a drilling fluid containing the recoverable lost circulation material. The lost circulation material is added to drilling fluids to control the loss of the drilling fluid into porous formations downhole. The drilling fluid collected at the surface, commonly known as spent drilling fluid, contains partial amounts of the recoverable lost circulation material and drill cuttings collected downhole. The recoverable lost circulation material is designed such that it can be substantially recovered from the spent drilling fluid separately from the drill cuttings contained in the spent drilling fluid.

The recoverable lost circulation material possesses a characteristic that renders it distinguishable from the drill cuttings, thus allowing it to be separated from the drill cuttings. For example, the recoverable lost circulation material can be a magnetic material, such as magnetic particles, a partially encapsulated magnetic material, a completely encapsulated magnetic material, or a combination thereof. The magnetic material can be encapsulated in a polymeric material, such as plastic, nylon, carbon fiber, and the like, and used as the recoverable lost circulation material. A predetermined amount of the recoverable lost circulation material, based on the formation parameters, is added to the drilling fluid prior to being implemented into a drilling operation. It should be understood and appreciated that the magnetic material can be any ferromagnetic or paramagnetic material.

The magnetic particles can be portions of iron (ferrous), nickel, cobalt, steel, aluminum, copper, or combinations thereof. More specific examples of ferrous materials are ferrite and hematite. The magnetic particles can be sized in the range of from about 100 microns to about ¼ inch and are not limited to any specific shape. For example, the particles can be spherical, cylindrical, discoidal, tubular, ellipsoidal, equant, irregular, or combinations thereof.

Other embodiments of the present invention are methods of using and recovering the recoverable lost circulation material from the spent drilling fluid. The method of using the recoverable lost circulation material includes the step of introducing a predetermined amount of the recoverable lost circulation material into the drilling fluid prior to introducing the drilling fluid into the drill string 22. Generally, the drilling fluid is stored and prepared in mud pits 14 while the recoverable lost circulation material is stored separately in the lost circulation material storage apparatus 16, or any suitable apparatus known in the art. It should be appreciated, however, that the drilling fluid can be stored and prepared in any container or apparatus capable of storing a necessary amount of drilling fluid for any particular drilling operation. The introduction of the recoverable lost circulation material to the drilling fluid can be done in the mud pits 14, in any suitable container, or on-the-fly as the drilling fluid is being introduced to the subterranean formation 12. Once the drilling fluid containing the recoverable lost circulation material has been prepared, the drilling fluid is introduced into the well bore 26 via the drill string 22. A portion of the recoverable lost circulation material contacts the porous formation 12 and plugs the porous formation 12 to prevent the loss of drilling fluid into the formation 12. The drilling fluid is then forced into an annulus 28 between the drill string 22 and a wall 30 of the well bore 26 and up toward the surface. After exiting the drill string 22 and while being forced up toward the surface, the drilling fluid contacts drill cuttings created by the drilling and transports them to the surface. The spent drilling fluid containing the recoverable lost circulation material and the drill cuttings is captured at the surface and taken to recover the recoverable lost circulation material and remove the drill cuttings.

The method of recovering the recoverable lost circulation material includes the step of introducing the spent drilling fluid to a magnetic separator apparatus 18 to substantially remove the recoverable lost circulation material from the spent drilling fluid while leaving the drill cuttings in the spent drilling fluid. The magnetic separator apparatus 18 can be any suitable apparatus known in the art capable of separating magnetic particles from a non-magnetic fluid, such as a wet drum magnet, magnetic conveyor belt, magnetic plate, immersion magnet, magnetic auger, and a magnetic centrifuge. Another step comprises introducing the spent drilling fluid to a solids control apparatus 20 to remove the drill cuttings from the spent drilling fluid. The solids control apparatus 20 can be any suitable apparatus capable of removing drill cuttings from spent drilling fluid known in the art, such as shale shakers. The removed drill cuttings are discarded in any suitable manner known in the art.

The spent drilling fluid having the recoverable lost circulation material and the drill cuttings removed is returned to the mud pits 14 to be reintroduced into the well bore 26 via the drill string 22. The recoverable lost circulation material recovered from the spent drilling fluid can be reintroduced to the drilling fluid in the mud pits 14 or stored in the storage apparatus 16 for the recoverable lost circulation material so that it can be added to the drilling fluid at a later time.

Changes may be made in the combination of materials of the composition and the steps or the sequence of steps of the methods described herein without departing from the spirit and scope of the present invention. Other features and advantages of the present invention are apparent from the detailed description.

What is claimed is:

1. A method to recover a lost circulation material from a drilling fluid used in a drilling operation comprising the steps of:

directing a drilling fluid containing a lost circulation material into a drill string positioned in a well bore, the lost circulation material having a plurality of magnetic particles wherein the magnetic particles are sized greater than 100 microns;

recovering the drilling fluid containing at least a portion of the lost circulation material from the well bore; and magnetically separating the lost circulation material from the drilling fluid.

2. The method of claim 1 comprising the step of:

adding the lost circulation material to the drilling fluid prior to the step of directing.

3. A drilling system to be used in a drilling operation comprising:

a drill string positioned in a well bore, the drill string having a drill head apparatus, the well bore having a bottom portion and a top portion, the drill head apparatus operating substantially in the bottom portion of the well bore;

means for injecting a drilling fluid containing a lost circulation material into the drill string, the lost circulation material having a plurality of magnetic particles wherein the magnetic particles are sized greater than 100 microns, the drilling fluid containing the lost circulation material exiting the drill string from the drill head apparatus;

means for recovering the drilling fluid containing at least a portion of the lost circulation material from the top portion of the well bore; and a magnetic separator apparatus receiving the recovered drilling fluid containing at least a portion of the lost circulation material and separating the lost circulation material from the drilling fluid.

4. The drilling system of claim 3, further comprising:

a lost circulation material storage apparatus positioned to receive the recovered lost circulation material from the magnetic separator apparatus.

5. The drilling system of claim 3, further comprising:

a drilling fluid storage apparatus receiving the recovered drilling fluid from the separator apparatus.

* * * * *